US011164498B1

(12) United States Patent
Peng et al.

(10) Patent No.: US 11,164,498 B1
(45) Date of Patent: Nov. 2, 2021

(54) DISPLAY PANEL AND TEST METHOD THEREOF

(71) Applicant: TCL CHINA STAR OPTOELECTRONICS TECHNOLOGY CO., LTD., Shenzhen (CN)

(72) Inventors: Bangyin Peng, Shenzhen (CN); Ilgon Kim, Shenzhen (CN)

( * ) Notice: Subject to any disclaimer, the term of this patent is extended or adjusted under 35 U.S.C. 154(b) by 0 days.

(21) Appl. No.: 16/981,730

(22) PCT Filed: Jul. 1, 2020

(86) PCT No.: PCT/CN2020/099661
§ 371 (c)(1),
(2) Date: Sep. 17, 2020

(30) Foreign Application Priority Data

Apr. 17, 2020 (CN) ..... 202010306490.3

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01); *G09G 2330/12* (2013.01)

(58) Field of Classification Search
None
See application file for complete search history.

(56) References Cited

U.S. PATENT DOCUMENTS 6,307,613 B1 * 10/2001 Iida ..... G02F 1/133528 349/110
2013/0113839 A1 * 5/2013 Huang ..... G02B 30/34 345/690
2016/0049118 A1 2/2016 Chen et al.

FOREIGN PATENT DOCUMENTS

CN 104157254 A 11/2014
CN 108873404 A 11/2018
CN 109285520 A 1/2019
CN 109285521 A 1/2019
CN 109493825 A 3/2019
JP H0688766 A 3/1994

* cited by examiner

*Primary Examiner* — Christopher J Kohlman

(57) ABSTRACT

A display panel and a test method thereof are provided in the preset disclosure. The display panel includes a first test area and a second test area; the display panel also includes an array substrate, a pixel electrode layer, and a light shielding layer, wherein the pixel electrode layer includes a plurality of pixel electrode units, and in a direction perpendicular to the array substrate, an orthographic projection of the light shielding layer covers orthographic projections of each main pixel electrode in the first test area and each sub-pixel electrode in the second test area.

14 Claims, 5 Drawing Sheets

DISPLAY PANEL AND TEST METHOD THEREOF

FIELD OF INVENTION

The present disclosure relates to the field of display technology, and in particular to a display panel and a test method thereof.

BACKGROUND OF INVENTION

With development of display technology, in order to decrease color deviation problem of a display panel in the case of large viewing angle, a pixel electrode unit (pixel) in the display panel is divided into a main pixel electrode (main-pixel) and a sub-pixel electrode (sub-pixel). Differences in brightness of the main pixel electrode and the sub-pixel electrode are provided to compensate the viewing angle, and thus the color deviation of the large viewing angle is decreased. Obviously, an effect of improving the viewing angle mainly depends on the brightness differences (that is, the voltage division relationship) between the main pixel electrode and the sub-pixel electrode, and the data is mainly reflected in the voltage-brightness characteristic curve (VT Curve) relationship between the main pixel electrode and the sub-pixel electrode.

Technical Problem

Currently, in actual tests, only the overall voltage-brightness characteristic curve of the pixel electrode unit can be measured, but the respective voltage-brightness characteristic curves of the main pixel electrode and the sub-pixel electrode cannot be measured separately, and thus it is difficult to thoroughly and qualitatively study the voltage division relationship between the main pixel electrode and the sub-pixel electrode, which troubles developers in design and evaluation of such pixel electrode structures.

SUMMARY OF INVENTION

The embodiments of the present disclosure provide a display panel and a test method thereof, so as to solve the technical problem that the brightness characteristic curves of the main pixel electrode and the sub-pixel electrode cannot be separately measured in the existing display panel.

To solve the above problem, the technical solutions provided in the present disclosure are as follows:

The present disclosure provides a display panel comprising a display area and a first test area and a second test area located in the display area; the display panel comprises:

An array substrate;

A pixel electrode layer located on the array substrate and corresponding to the display area, the pixel electrode layer includes a plurality of pixel electrode units arranged in an array, and each of the pixel electrode units includes a main pixel electrode and a sub-pixel electrode; and A light shielding layer arranged on the pixel electrode layer;

Wherein, in a direction perpendicular to the array substrate, an orthographic projection of the light shielding layer covers orthographic projections of each of the main pixel electrodes located in the first test area and each of the sub-pixel electrodes located in the second test area.

The display panel of the present disclosure further includes a black matrix disposed over the array substrate, and the light shielding layer and the black matrix are made of a same material and are integrally formed.

In the display panel of the present disclosure, the first test area and the second test area are located in middle of the display area.

In the display panel of the present disclosure, the first test area and the second test area have a same shape and a same area.

In the display panel of the present disclosure, the display panel further comprises a third test area, the third test area is located in the display area, and the light shielding layer is located outside the third test area.

In the display panel of the present disclosure, the first test area, the second test area, and the third test area are sequentially arranged at equal intervals.

In the display panel of the present disclosure, the array substrate comprises a first TFT connected to the main pixel electrode, a second TFT connected to the sub-pixel electrode, and a third TFT connected to the second TFT.

The present disclosure further provides a display panel comprising a display area and a first test area and a second test area located in the display area; wherein the display panel comprises:

An array substrate;

A pixel electrode layer located on the array substrate and corresponding to the display area, the pixel electrode layer includes a plurality of pixel electrode units arranged in an array, and each of the pixel electrode units includes a main pixel electrode and a sub-pixel electrode; and A light shielding layer arranged on the pixel electrode layer;

Wherein, in a direction perpendicular to the array substrate, an orthographic projection of the light shielding layer covers orthographic projections of each of the main pixel electrodes located in the first test area and each of the sub-pixel electrodes located in the second test area, and The display panel further includes a third test area, the third test area is located in the display area, and the light shielding layer is located outside the third test area.

In the display panel of the present disclosure, the display panel further includes a black matrix disposed over the array substrate, and the light shielding layer and the black matrix are made of a same material and integrally formed.

In the display panel of the present disclosure, the first test area and the second test area are located in middle of the display area.

In the display panel of the present disclosure, the first test area and the second test area have a same shape and a same area.

In the display panel of the present disclosure, the first test area, the second test area, and the third test area are sequentially arranged at equal intervals.

In the display panel of the present disclosure, the array substrate includes a first TFT connected to the main pixel electrode, a second TFT connected to the sub-pixel electrode, and a third TFT connected to the second TFT.

The present disclosure further provides a test method of a display panel for measuring a voltage-brightness characteristic curve of the display panel in the foregoing embodiment comprising following steps:

Activating the display panel; and

Measuring a voltage-brightness characteristic curve of the sub-pixel electrode located in the first test area, a voltage-brightness characteristic curve of the main pixel electrode located in the second test area, and a voltage-brightness characteristic curve located outside the first test area and the second test area and outside the display area.

In the test method of the display panel of the present disclosure, the first test area and the second test area are located in the middle of the display area, and test positions configured to separately measure the voltage-brightness characteristic curve of the sub-pixel electrode in the first test area and the voltage-brightness characteristic curve of the main pixel electrode in the second test area are both located in the middle of the display area.

In the test method of the display panel of the present disclosure, the display panel further comprises a third test area located in the display area, and measuring the voltage-brightness characteristic curve located outside the first test area and the second test area and in the display area comprises:

Measuring a voltage-brightness characteristic curve of the pixel electrode unit located in the third test area.

Beneficial Effect

The beneficial effects of the present disclosure are: in the present disclosure, the display area of the display panel divides into at least the first test area and the second test area, and each of the main pixel electrodes located in the first test area and each of the sub-pixel electrode located in the second test area are shield by a light shielding layer so as to measure the voltage-brightness characteristic curve of the sub-pixel electrodes located in the first test area and the voltage-brightness characteristic curve of the sub-pixel electrode in the second test area, and achieve the accurate measurement of the voltage-brightness characteristic curve of the sub-pixel electrode and the main pixel electrode respectively, which is convenient to provide support for subsequent design and evaluation of the pixel electrode unit.

DESCRIPTION OF DRAWINGS

In order to explain embodiments or technical solutions in the prior art more clearly, the following will briefly introduce the drawings that need to be used in the description of the embodiments or the prior art. Obviously, the drawings in the following description are merely some embodiments of the present disclosure, those of ordinary skill in the art can obtain other drawings based on these drawings without creative work.

DETAILED DESCRIPTION OF PREFERRED EMBODIMENTS

Figure 1:
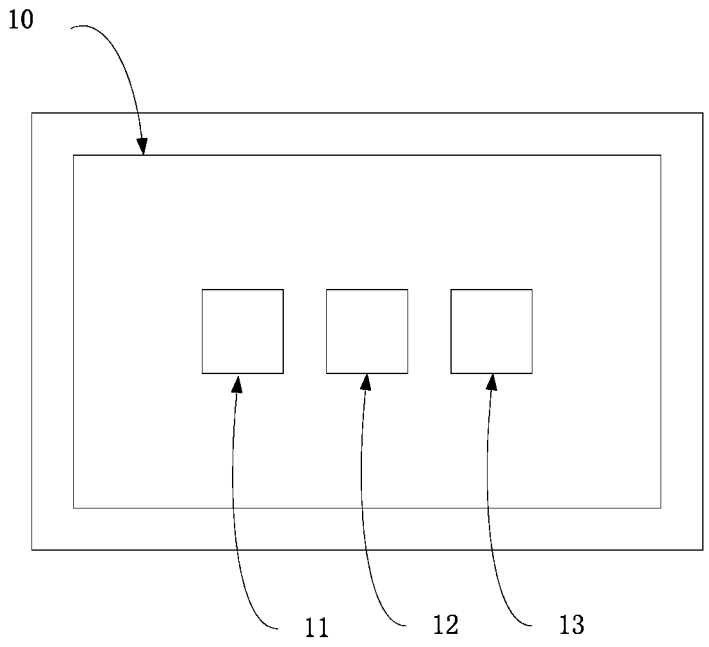
FIG. 1 is a top diagram of a display panel in an embodiment of the present disclosure.

The description of the following embodiments refers to the attached drawings to illustrate specific embodiments in which the present disclosure can be implemented. The directional terms mentioned in the present disclosure, such as [up], [down], [front], [back], [left], [right], [inner], [outer], [side], etc., are only the direction of the attached drawings. Therefore, the directional terms used are used to describe and understand the present disclosure, rather than to limit the present disclosure. In the drawings, units with similar structures are indicated by the same reference numerals.

In the description of the present disclosure, it should be understood that orientations or position relationships indicated by the terms "center", "longitudinal", "lateral", "length", "width", "thickness", "upper", "lower", "front", "rear", "left", "right", "vertical", "horizontal", "top", "bottom", "inside", "outside", "clockwise", and "counter-clockwise" are based on orientations or position relationships illustrated in the drawings. The terms are used to facilitate and simplify the description of the present disclosure, rather than indicate or imply that the devices or elements referred to herein are required to have specific orientations or be constructed or operate in the specific orientations. Accordingly, the terms should not be construed as limiting the present disclosure. In addition, the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

In the description of the present disclosure, it should be noted that unless otherwise clearly defined and limited, the terms "mounted", "connected/coupled", and "connection" should be interpreted broadly. For example, the terms may refer to a fixed connection, a detachable connection, or an integral connection; the terms may also refer to a mechanical connection, an electrical connection, or communication with each other; the terms may further refer to a direct connection, an indirect connection through an intermediary, or an interconnection between two elements or interactive relationship between two elements. Those skilled in the art can understand the specific meanings of the above-mentioned terms in the present disclosure according to circumstances.

In the present disclosure, it should be noted that unless otherwise clearly defined and limited, a first feature "on" or "under" a second feature may mean that the first feature directly contacts the second feature, or that the first feature contacts the second feature via an additional feature there between instead of directly contacting the second feature. Moreover, the first feature "on", "above", and "over" the second feature may mean that the first feature is right over or obliquely upward over the second feature or mean that the first feature has a horizontal height higher than that of the second feature. The first feature "under", "below", and "beneath" the second feature may mean that the first feature is right beneath or obliquely downward beneath the second feature or mean that that horizontal height of the first feature is lower than that of the second feature.

The following description provides various embodiments or examples for implementing various structures of the present disclosure. To simplify the description of the present disclosure, parts and settings of specific examples are described as follows. Certainly, they are only illustrative, and are not intended to limit the present disclosure. Further, reference numerals and reference letters may be repeated in different examples. This repetition is for purposes of simplicity and clarity and does not indicate a relationship of the various embodiments and/or the settings. Furthermore, the present disclosure provides specific examples of various processes and materials, however, applications of other processes and/or other materials may be appreciated those skilled in the art.

The technical solution of the present disclosure will now be described in conjunction with specific embodiments.

The present disclosure provides a display panel, as shown in FIGS. 1 to 5, the display panel comprises a display area 10 and a first test area 11 and a second test area 12 located in the display area 10. The display panel includes: an array substrate 100; a pixel electrode layer 200 located on the array substrate 100 and corresponding to the display area 10, and the pixel electrode layer 200 includes a plurality of pixel electrode units 210 arranged in an array, and each of the pixel electrode units 210 includes a main pixel electrode 211 and a sub-pixel electrode 212; and a light shielding layer 300 disposed on the pixel electrode layer 200. In a direction perpendicular to the array substrate 100, an orthographic projection of the light-shielding layer 300 covers orthographic projections of each of the main pixel electrodes 211 located in the first test area 11 and each of the sub-pixel electrodes 212 located in the second test area 12.

It can be understood that, in the existing display panel that decrease the color deviation problem of the display panel in the case of large viewing angle by dividing the pixel electrode unit 210 (pixel) into a main pixel electrode 211 (main-pixel) and a sub-pixel electrode 212 (sub-pixel), it is difficult to measure the voltage-brightness characteristic curve of the sub-pixel electrode 212 or the main pixel electrode 211 separately, and it is inconvenient to design and study the voltage division structure of the sub-pixel electrode 212 and the main pixel electrode 211. In the present disclosure, the display area 10 is divided into at least a first test area 11 and a second test area 12, and combined with the light shielding layer 300 to shield each of the main pixel electrodes 211 in the first test area 11 and each of the sub-pixel electrodes 212 in the second test area 12, it is convenient to measure the voltage-brightness characteristic curve of the sub-pixel electrodes 212 in the first test area 11 and the voltage-brightness characteristic curve of the main pixel electrodes 211 in the second test area 12 respectively, which achieves the purpose of accurately measuring the voltage-brightness characteristic curve of the sub-pixel electrode 212 and the main pixel electrode 211 respectively. Obviously, the overall structure is relatively simple and practical.

Specifically, in the first test area 11, each of the main pixel electrodes 211 in the first test area 11 is shielded by the light shielding layer 300, so as to obtain brightness of the sub-pixel electrode 212 in the first test area 11 through measuring instruments and can also obtain a driving voltage of the sub-pixel electrode 212 through a driving circuit in the display panel, thereby completing the measurement of the voltage-brightness characteristic curve of the sub-pixel electrode 212. Similarly, in the second test area 12, each of the sub-pixel electrodes 212 in the second test area 12 is shielded by the light-shielding layer 300, so as to obtain brightness of the main pixel electrode 211 through optical measuring instruments and can also obtain a driving voltage of the main pixel electrode 211 through the driving circuit in the display panel, thereby completing the measurement of the voltage-brightness characteristic curve of the main pixel electrode 211. Of course, in addition to the structure of the present disclosure in which the light shielding layer shield each of the main pixel electrode 211 in the first test area 11 and each of the sub-pixel electrode 212 in the second test area 12, other effective measurement methods may be adopted, and no restriction is made herein.

Figure 5:
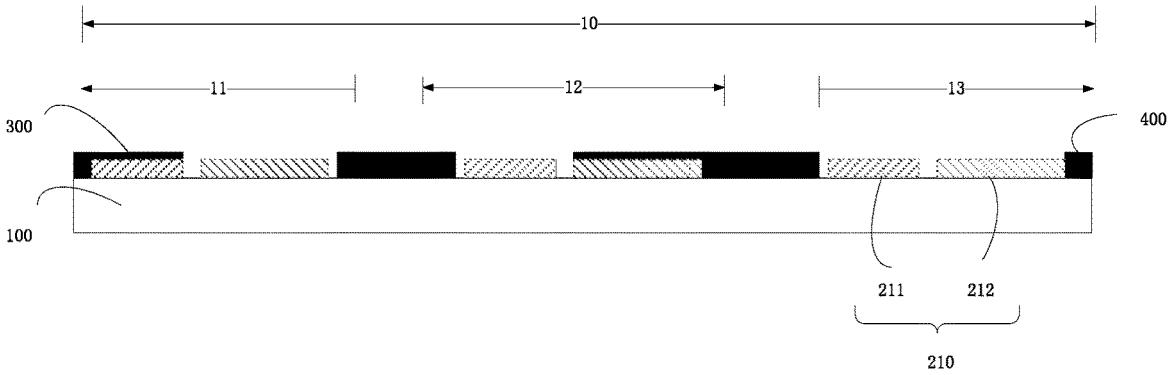
FIG. 5 is a tiered schematic structural diagram of the display panel in an embodiment of the present disclosure.

In one embodiment, as shown in FIG. 5, the display panel further comprises a black matrix 400 disposed over the array substrate 100. The light shielding layer 300 and the black matrix 400 are made of the same material and are integrally formed. Specifically, the black matrix 400 is disposed on the array substrate 100 and located between the pixel electrode units 210 to achieve the maximum light shielding effect. It should be understood that the display panel further comprises the black matrix 400, the light shielding layer 300 and the black matrix 400 are made of the same material and set as an integral structure. Obviously, the structure of the display panel makes the structure of the display panel more compact and avoids the increase in the overall panel thickness of the display panel due to the increase in the structure of the light shielding layer 300. In the manufacture of the display panel, the black matrix 400 and the light shielding layer 300 are manufactured in one process, which avoids complication of the process due to the increase in the structure of the light shielding layer 300, and does not affect the overall manufacturing process of the display panel, and is suitable for mass production.

In an embodiment, as shown in FIG. 1, the first test area 11 and the second test area 12 are located in the middle of the display area 10. It can be understood that, in the display panel, compared with the pixel electrode units 210 in the peripheral area of the display area 10, the pixel electrode units 210 in the middle of the area 10 are arranged more uniformly and emit light more saturated. By arranging the first test area 11 and the second test area 12 in the middle of the display area 10, it is more conducive to obtain a more accurate voltage-brightness characteristic curve when the voltage-brightness characteristic curve of the sub-pixel electrode 212 located in the first test area 11 and the voltage-brightness characteristic curve of the main pixel electrode 211 located in the second test area 12 are measured separately. Specifically, the first test area 11 and the second test area 12 have the same shape and the same area; obviously, by controlling the first test area 11 and the second test area 12 to have the same shape and size, it prevents such factors from affecting the accuracy of the test. The first test area 11 and the second test area 12 may be rectangles of the same size and are arranged in the middle of the display area 10; further, the first test area 11 and the second test area 12 can be arranged adjacent to each other, and can be arranged at a certain distance from each other to avoid the interference of mutual display brightness.

In one embodiment, as shown in FIG. 1, the display panel further includes a third test area 13, the third test area 13 is located in the display area 10, and the light shielding layer 300 is located outside the third test area 13, and it can be understood that the third test area 13 is configured to measure the overall voltage-brightness characteristic curve of the pixel electrode unit 210 including the main pixel electrode 211 and the sub-pixel electrode 212. Specifically, no light shielding layer 300 is provided in the third test area 13, and the part of the display panel located in the third test area 13 have the same structure as the part of the display panel located in the display area 10. Obviously, the third test area 13 defines the position to measure overall voltage-brightness characteristic curve of the pixel electrode unit 210. Specifically, the third test area 13 is also located in the middle of the display area 10. The first test area 11, the second test area 12 and the third test zone 13 are arranged in sequence at equal intervals; as described above, this arrangement and structure can maximize the accuracy of the test.

Figure 2:
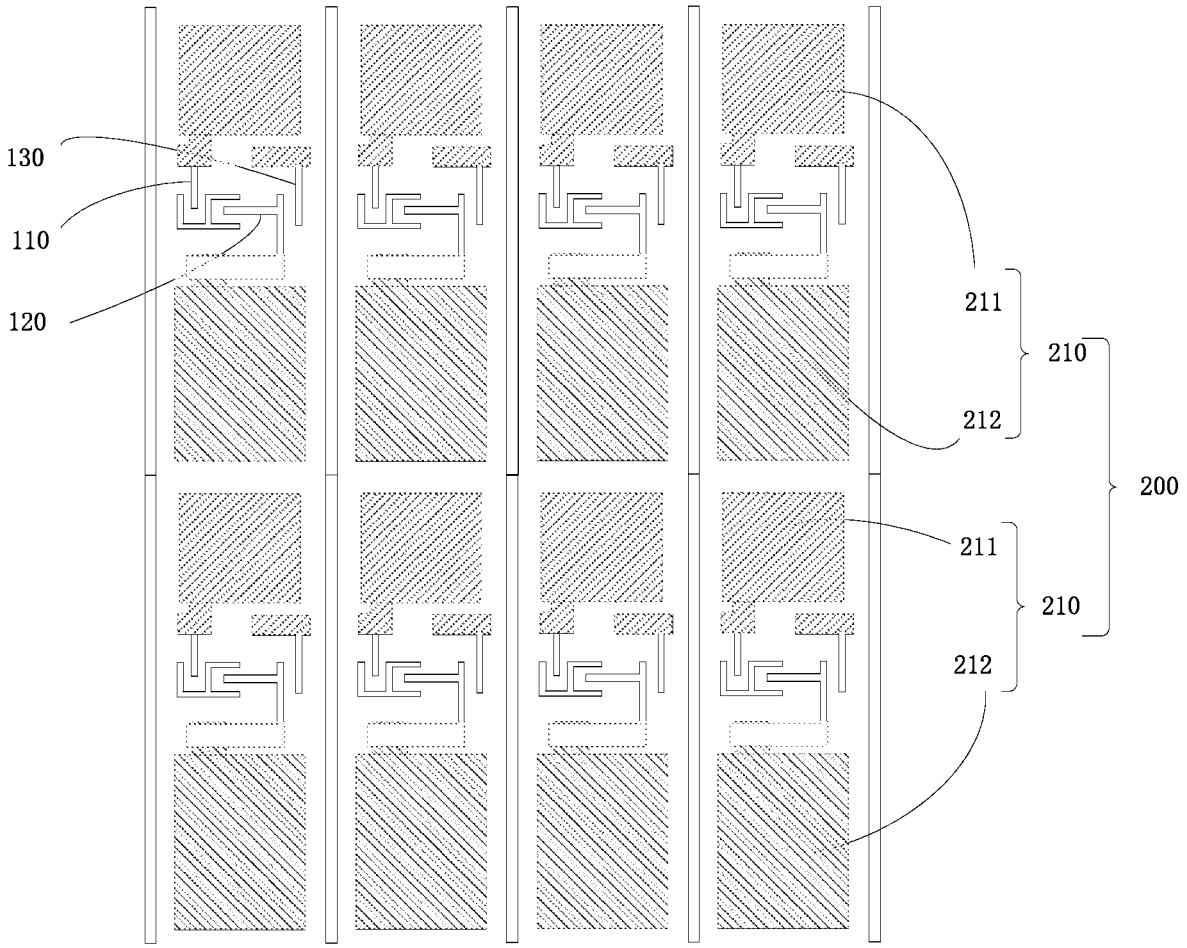
FIG. 2 is a schematic structural diagram of a third test area in FIG. 1.
Figure 3:
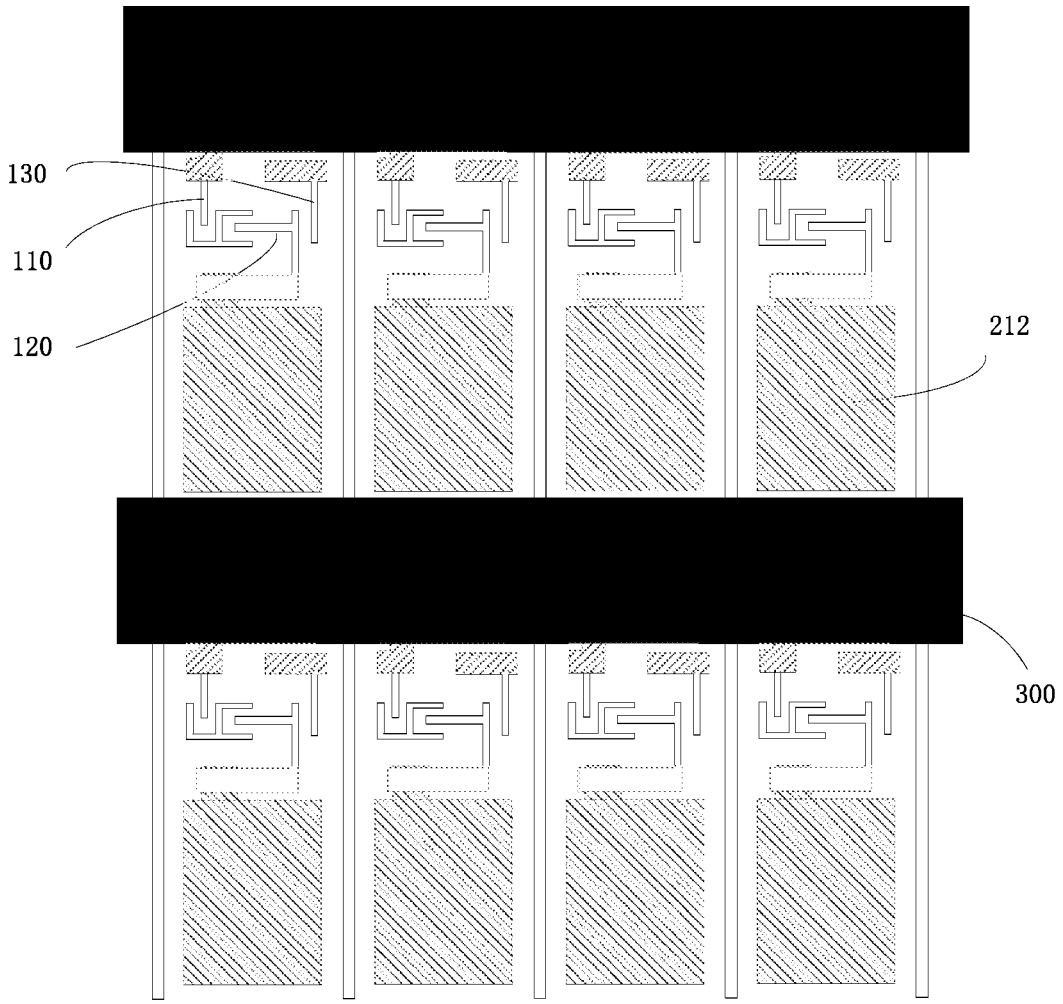
FIG. 3 is a schematic structural diagram of a first test area in FIG. 1.
Figure 4:
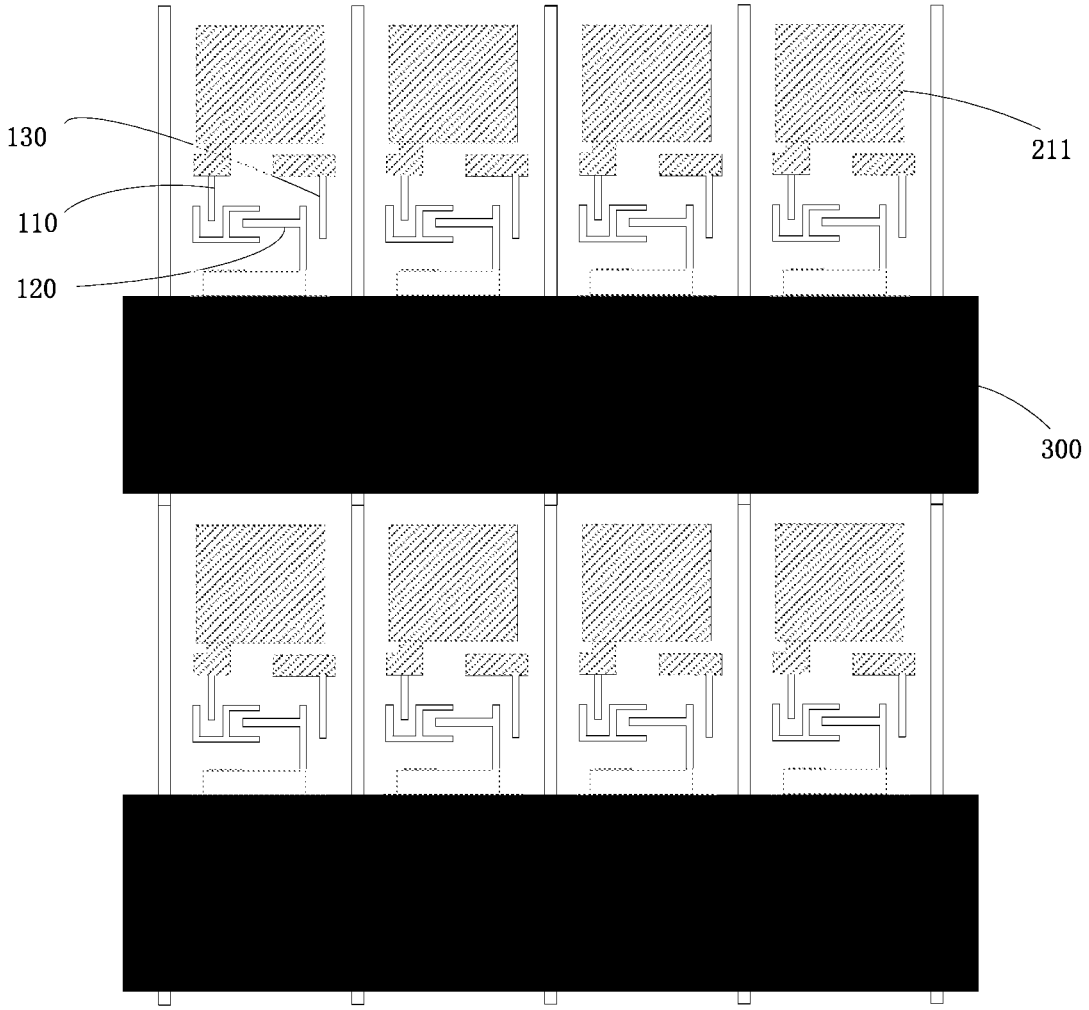
FIG. 4 is a schematic structural diagram of a second test area in FIG. 1.

In one embodiment, as shown in FIG. 2, the array substrate 100 includes a first TFT 110 connected to the main pixel electrode 211, a second TFT 120 connected to the sub pixel electrode 212, and a third TFT 130 connected to the TFT 120. It can be understood that the driving circuit structure of the display panel may be a 3T structure. During the display process of the display panel, the first TFT 110 is connected to the main pixel electrode 211 to drive the main pixel electrode 211, the second TFT 120 is connected to the sub pixel electrode 212 to drive the sub pixel electrode 212, and the third TFT 130 is connected to the second TFT 120 to divide the voltage of the second TFT 120. The specific driving method and the voltage division form are relatively mature technologies, and will not be repeated here. It should be noticed that, in the present disclosure, the voltage data of the voltage-brightness characteristic curve of the main pixel electrode 211, the sub-pixel electrode 212 and the pixel electrode unit 210 can be obtained according to the first TFT 110, the second TFT 120, and the third TFT 130.

Figure 6:
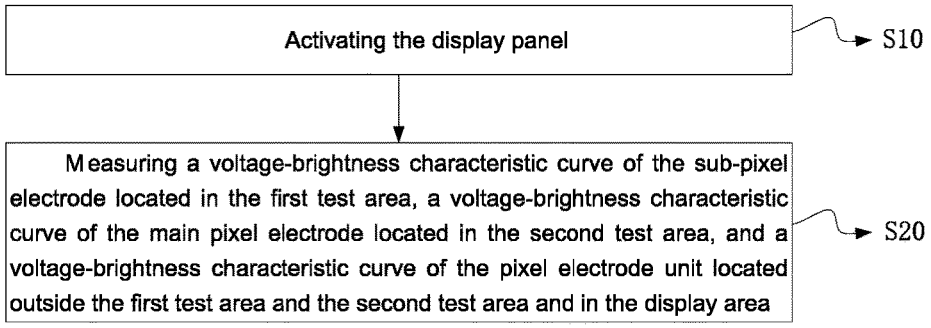
FIG. 6 is a schematic block diagram of a flow of a method for testing a display panel in an embodiment of the present disclosure.

The present disclosure also provides a test method of a display panel. As shown in FIG. 6, measuring the voltage-brightness characteristic curve of any one of the foregoing display panels comprises the following steps:

Step S10: activating the display panel; and

Step S20: measuring the voltage-brightness characteristic curve of the sub-pixel electrode 212 in the first test area 11 and the voltage-brightness characteristic curve of the main pixel electrode 211 in the second test area 12 respectively, and a voltage-brightness characteristic curve of the pixel electrode unit 210 located outside the first test area 11 and the second test area 12 and in the display area 10.

It can be understood that, the voltage-brightness characteristic curve of the sub-pixel electrode 212 located in the first test area 11, the voltage-brightness characteristic curve of the main pixel electrode 211 located in the second test area 12, and the voltage-brightness characteristic curve of the pixel electrode unit 210 located outside the first test area 11 and the second test area 12 and in the display area 10 are respectively measured, after the display panel is activated or in response to the operation of activating the display panel. It should be noticed that when measuring the voltage-brightness characteristic curve of the sub-pixel electrode 212 located in the first test area 11, the voltage-brightness characteristic curve of the main pixel electrode 211 in the test area 12, and the voltage-brightness characteristic curve of the pixel electrode unit located outside the first test area 11 and the second test area 12 and located in the display area 10, the order of measuring the voltage-brightness characteristic curve of the sub-pixel electrode 212, the voltage-brightness characteristic curve of the main pixel electrode 211 and the voltage-brightness characteristic curve of the pixel electrode unit 210 is not limited, but the measurement time can be set after the display panel has been activated for a period of time, and the test is performed after the display of the display panel has stabilized.

In an embodiment, the first test area 11 and the second test area 12 are located in the middle of the display area 10, and the test positions configured to separately measure the voltage-brightness characteristic curve of the sub-pixel electrodes 212 located in the first test area 11 and the voltage-brightness characteristic curve of the main pixel electrode 211 in the second test area 12 are all located in the middle of the display area 10. Obviously, in the display panel, compared with the pixel electrode units 210 located in the peripheral area of the display area 10, the pixel electrode units 210 in the middle of the display area 10 are arranged more uniformly and emit light more saturated. By arranging the first test area 11 and the second test area 12 in the middle of the display area 10, it is more conducive to obtain more accurate voltage-brightness characteristic curve when separately measuring the voltage-brightness characteristic curve of the sub-pixel electrode 212 located in the first test area 11 and the voltage-brightness characteristic curve of the main pixel electrode 211 located in the second test area 12.

In an embodiment, the display panel further includes a third test area 13 in the display area 10, and measuring the voltage-brightness characteristic curve of the pixel electrode unit 210 located outside the first test area 11 and the second test area 12 and in the display area 10 includes:

Measuring a voltage-brightness characteristic curve of the pixel electrode unit 210 in the third test area 13; obviously, the third test area 13 defines the position of the voltage-brightness characteristic curve of the pixel electrode unit 210 as a whole. Specifically, the third test area 13 is also located in the middle of the display area 10, and the first test area 11, the second test area 12, and the third test area 13 are arranged in sequence at equal intervals. As mentioned above, this arrangement and structure avoids interference from other factors in the test to the greatest extent, ensures the accuracy of the test, and facilitates subsequent analysis and research.

The beneficial effect of the present disclosure is that at least the first test area 11 and the second test area 12 are divided in the display area 10 of the display panel, and each of the main pixel electrode 211 in the first test area 11 and each of the sub-pixel electrodes 212 located in the second test area 12 are shield by the light shielding layer 300, so as to measure the voltage-brightness characteristic curves of the sub-pixel electrode 212 located in the first test area 11 and the voltage-brightness characteristic curve of the main pixel electrode 211 in the second test area 12 respectively, and achieve the accurate measurement of the voltage-brightness characteristic curve of the sub-pixel electrode 212 and the main pixel electrode 211, which is convenient to provide support for subsequent design and evaluation of the pixel electrode unit 210.

In summary, although preferred embodiments have been described above in the present disclosure, the above-mentioned preferred embodiments are not intended to limit the present disclosure. Those of ordinary skilled in the art can make various modifications and changes without departing from the spirit and scope of the present disclosure. Therefore, the protection scope of the present disclosure is subject to the scope defined by the claims.

What is claimed is:

1. A display panel, comprising a display area, and a first test area and a second test area located in the display area, wherein the display panel comprises:

an array substrate;

a pixel electrode layer located on the array substrate and corresponding to the display area, and the pixel electrode layer includes a plurality of pixel electrode units arranged in an array, and each of the pixel electrode units includes a main pixel electrode and a sub-pixel electrode; and a light shielding layer arranged on the pixel electrode layer;

wherein the display panel further comprises a black matrix disposed over the array substrate, and the light shielding layer and the black matrix are made of a same material and are integrally formed, and wherein in a direction perpendicular to the array substrate, an orthographic projection of the light shielding layer covers orthographic projections of each of the main pixel electrodes located in the first test area and each of the sub-pixel electrodes located in the second test area.

2. The display panel of claim 1, wherein the first test area and the second test area are located in middle of the display area.

3. The display panel of claim 1, wherein the first test area and the second test area have a same shape and a same area.

4. The display panel of claim 1, wherein the display panel further comprises a third test area, the third test area is located in the display area, and the light shielding layer is located outside the third test area.

5. The display panel of claim 4, wherein the first test area, the second test area, and the third test area are arranged sequentially at equal intervals.

6. The display panel of claim 1, wherein the array substrate comprises a first thin film transistor (TFT) connected to the main pixel electrode, a second TFT connected to the sub-pixel electrode, and a third TFT connected to the second TFT.

7. A display panel, comprising a display area, and a first test area and a second test area located in the display area, wherein the display panel comprises:

an array substrate;

a pixel electrode layer located on the array substrate and corresponding to the display area, and the pixel electrode layer includes a plurality of pixel electrode units arranged in an array, and each of the pixel electrode units includes a main pixel electrode and a sub pixel electrode; and a light shielding layer arranged on the pixel electrode layer;

wherein the display panel further comprises a black matrix disposed over the array substrate, and the light shielding layer and the black matrix are made of a same material and are integrally formed, wherein in a direction perpendicular to the array substrate, an orthographic projection of the light shielding layer covers orthographic projections of each of the main pixel electrodes located in the first test area and each of the sub-pixel electrodes located in the second test area; and the display panel further includes a third test area, the third test area is located in the display area, and the light shielding layer is located outside the third test area.

8. The display panel of claim 7, wherein the first test area and the second test area are located in middle of the display area.

9. The display panel of claim 7, wherein the first test area and the second test area have a same shape and a same area.

10. The display panel of claim 7, wherein the first test area, the second test area, and the third test area are sequentially arranged at equal intervals.

11. The display panel of claim 7, wherein the array substrate includes a first thin film transistor (TFT) connected to the main pixel electrode, a second TFT connected to the sub-pixel electrode, and a third TFT connected to the second TFT.

12. A test method of a display panel for measuring a voltage-brightness characteristic curve of the display panel of claim 1, comprising following steps:

activating the display panel; and measuring a voltage-brightness characteristic curve of the sub-pixel electrode located in the first test area, a voltage-brightness characteristic curve of the main pixel electrode located in the second test area, and a voltage-brightness characteristic curve of the pixel electrode unit located outside the first test area and the second test area and in the display area.

13. The test method of the display panel of claim 12, wherein the first test area and the second test area are located in middle of the display area, and test positions configured to separately measure the voltage-brightness characteristic curve of the sub-pixel electrode in the first test area and the voltage-brightness characteristic curve of the main pixel electrode in the second test area are both located in the middle of the display area.

14. The test method of the display panel of claim 12, wherein the display panel further comprises a third test area located in the display area, and measuring the voltage-brightness characteristic curve of the pixel electrode unit located outside the first test area and the second test area and in the display area comprises:

measuring a voltage-brightness characteristic curve of the pixel electrode unit located in the third test area.

* * * * *